US009689404B2

(12) United States Patent
Wang et al.

(10) Patent No.: US 9,689,404 B2
(45) Date of Patent: Jun. 27, 2017

(54) FAN FRAME HAVING TEMPERTURE DETECTING ELEMENT AND FAN HAVING TEMPERTURE DETECTING ELEMENT

(71) Applicant: SUNONWEALTH ELECTRIC MACHINE INDUSTRY CO., LTD., Kaohsiung (TW)

(72) Inventors: Ming-Sheng Wang, Kaohsiung (TW); Yung-Hui Wu, Kaohsiung (TW); Szu-Ying Tu, Kaohsiung (TW)

(73) Assignee: SUNONWEALTH ELECTRIC MACHINE INDUSTRY CO., LTD., Kaohsiung (TW)

( * ) Notice: Subject to any disclaimer, the term of this patent is extended or adjusted under 35 U.S.C. 154(b) by 431 days.

(21) Appl. No.: 14/456,523

(22) Filed: Aug. 11, 2014

(65) Prior Publication Data

US 2015/0063979 A1 Mar. 5, 2015

(30) Foreign Application Priority Data

Sep. 2, 2013 (TW) ..... 102131478 A

(51) Int. Cl.
*F04D 25/06* (2006.01)
*F04D 29/52* (2006.01)

(52) U.S. Cl.
CPC ..... *F04D 29/522* (2013.01); *F04D 25/0666* (2013.01)

(58) Field of Classification Search
CPC ..... F04D 25/0666; F04D 15/0263
(Continued)

(56) References Cited

U.S. PATENT DOCUMENTS 6,013,966 A 1/2000 Fehrenbacher et al.
7,841,541 B2 * 11/2010 Ardelt ..... F04D 27/001 236/44 C
(Continued)

FOREIGN PATENT DOCUMENTS

CN 201165991 Y 12/2008
CN 101349284 A 1/2009
(Continued)

OTHER PUBLICATIONS

Office Action and the Search Report issued on Apr. 21, 2016 by SIPO for the corresponding Chinese Patent Application No. 201410123203.X.
(Continued)

*Primary Examiner* — Kenneth Bomberg
*Assistant Examiner* — Sabbir Hasan
(74) *Attorney, Agent, or Firm* — WPAT, P.C., Intellectual Property Attorneys; Anthony King

(57) ABSTRACT

A fan frame and a fan having temperature detecting element are provided. The fan frame includes a body and a circuit board. The body includes an inlet. The circuit board is installed around the inlet of the body. The temperature detecting element traverses the inlet. The first wire electrically connects the first contact end and the first external contact terminal. The second wire electrically connects the second contact end and the second external contact terminal. At least one of the first wire and the second wire includes a plurality of bending sections. By utilizing the bending sections of the first wire or the second wire, the length of the first wire or the second wire can be increased. Therefore, the influence in the temperature detecting element caused by the circuit board can be lowered and the error of the detecting temperature can be decreased.

16 Claims, 5 Drawing Sheets

(58) Field of Classification Search
USPC ..... 374/141, 163, 208, 138, 135, 170
See application file for complete search history.

(56) References Cited

U.S. PATENT DOCUMENTS

| | | | | |
|---|---|---|---|---|
| 8,251,655 | B2 | 8/2012 | Chen et al. | |
| 8,253,026 | B2 * | 8/2012 | Strauss | H05K 1/0207 174/252 |
| 2009/0016879 | A1 | 1/2009 | Chen et al. | |

FOREIGN PATENT DOCUMENTS

| | | | |
|---|---|---|---|
| JP | 2000-283090 | A | 10/2000 |
| JP | 2002-310506 | A | 10/2002 |
| TW | 520150 | | 2/2003 |
| TW | 200904312 | | 1/2009 |
| TW | 201135177 | | 10/2011 |
| TW | 201135177 | A1 | 10/2011 |

OTHER PUBLICATIONS

English translation of the Search Report issued on Apr. 21, 2016 by SIPO for the corresponding Chinese Patent Application No. 201410123203.X.
English abstract translation of CN101349284A.
English abstract translation of JP 2000-283090A.
English abstract translation of TW201135177A1.
English abstract translation of JP 2002-310506A.
English abstract translation of CN201165991Y.
Office Action and Search Report issued on Jun. 17, 2015 by TIPO for the corresponding TW Patent Application No. 102131478.
English translation of the Search Report issued on Jun. 17, 2015 by TIPO for the corresponding TW Patent Application No. 102131478.
TW200904312 corresponds to US2009/0016879A1.
English abstract translation of TW 201135177.
English abstract translation of TW 520150.

* cited by examiner

FAN FRAME HAVING TEMPERTURE DETECTING ELEMENT AND FAN HAVING TEMPERTURE DETECTING ELEMENT

TECHNICAL FIELD

The present disclosure is related to a fan frame having temperature detecting element and a fan having temperature detecting element.

BACKGROUND

The temperature detecting element of the conventional fan is disposed on the inlet of the conventional fan so as to detect the ambient temperature of the inlet. The detected temperature signal is transmitted to a control system to control the conventional fan. Because the temperature detecting element is mounted on a circuit board, the temperature of the circuit board may influence the detected temperature of the temperature detecting element and may result in big error.

SUMMARY OF THE INVENTION

The present invention provides a fan frame having temperature detecting element. The fan frame includes a body and a circuit board. The body is used for accommodating an impeller, and the body includes an inlet. The circuit board is installed around the inlet of the body, the circuit board includes a temperature detecting element, a first contact end, a second contact end, a first external contact terminal, a second external contact terminal, a first wire and a second wire. The first contact end and the second contact end are connected to the temperature detecting element. The temperature detecting element traverses the inlet. The first wire electrically connects the first contact end and the first external contact terminal. The second wire electrically connects the second contact end and the second external contact terminal. At least one of the first wire and the second wire includes a plurality of bending sections.

The present invention provides a fan having temperature detecting element. The fan includes a stator, an impeller and a fan frame. The fan frame includes a body and a circuit board. The body is used for accommodating the impeller and the stator, and the body includes an inlet. The circuit board is installed around the inlet of the body, the circuit board includes a temperature detecting element, a first contact end, a second contact end, a first external contact terminal, a second external contact terminal, a first wire and a second wire. The first contact end and the second contact end are connected to the temperature detecting element. The temperature detecting element traverses the inlet. The first wire electrically connects the first contact end and the first external contact terminal. The second wire electrically connects the second contact end and the second external contact terminal. At least one of the first wire and the second wire includes a plurality of bending sections.

By utilizing the bending sections of the first wire or the second wire, the length of the first wire or the second wire can be increased. Therefore, the influence in the temperature detecting element caused by the circuit board can be lowered and the error of the detecting temperature can be decreased.

DETAIL DESCRIPTION

Figure 1:
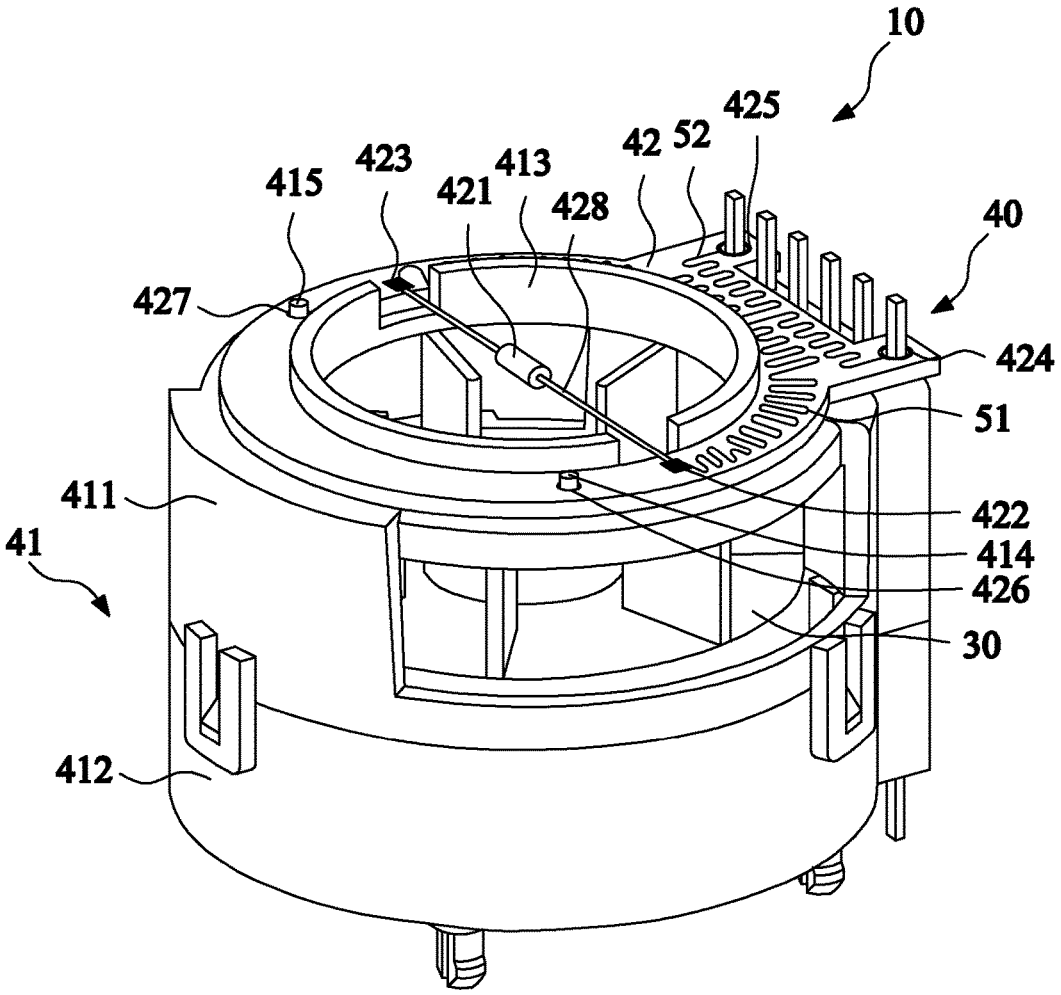
FIG. 1 is a perspective view of a fan in accordance with some embodiments.
Figure 2:
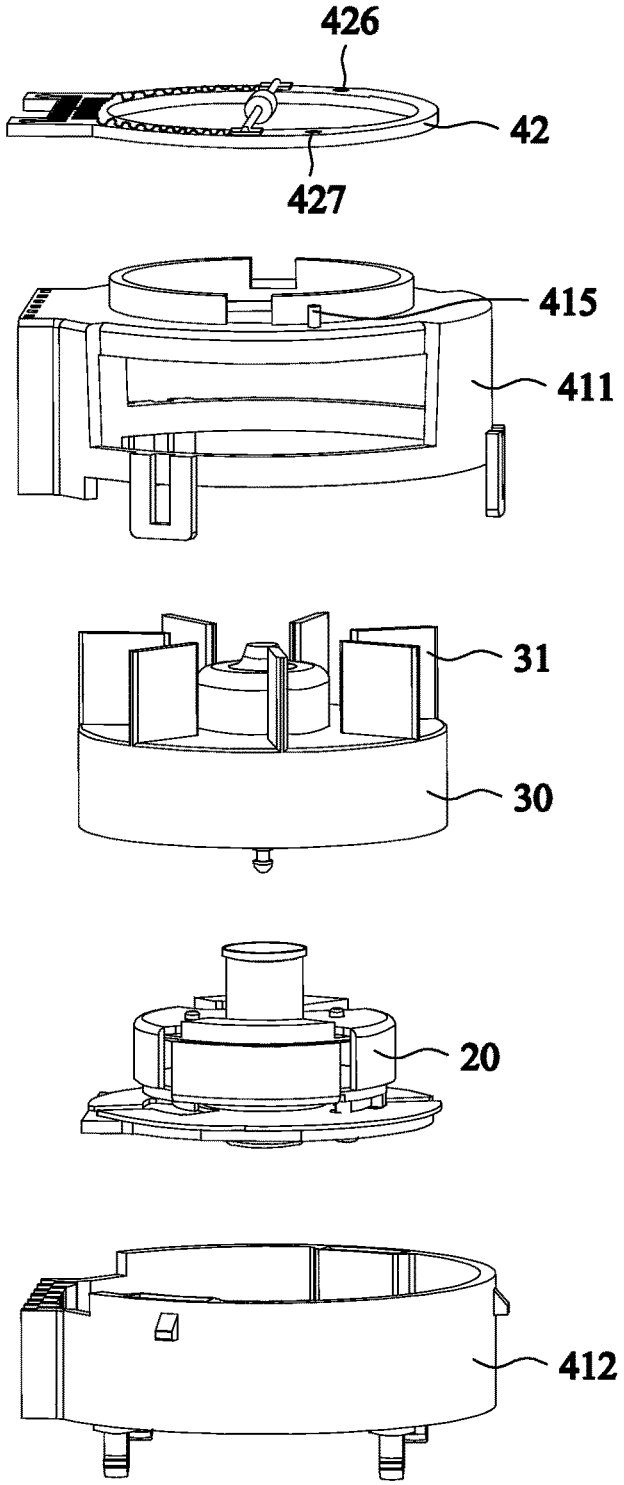
FIG. 2 is an exploded perspective view of a fan in accordance with some embodiments.
Figure 3:
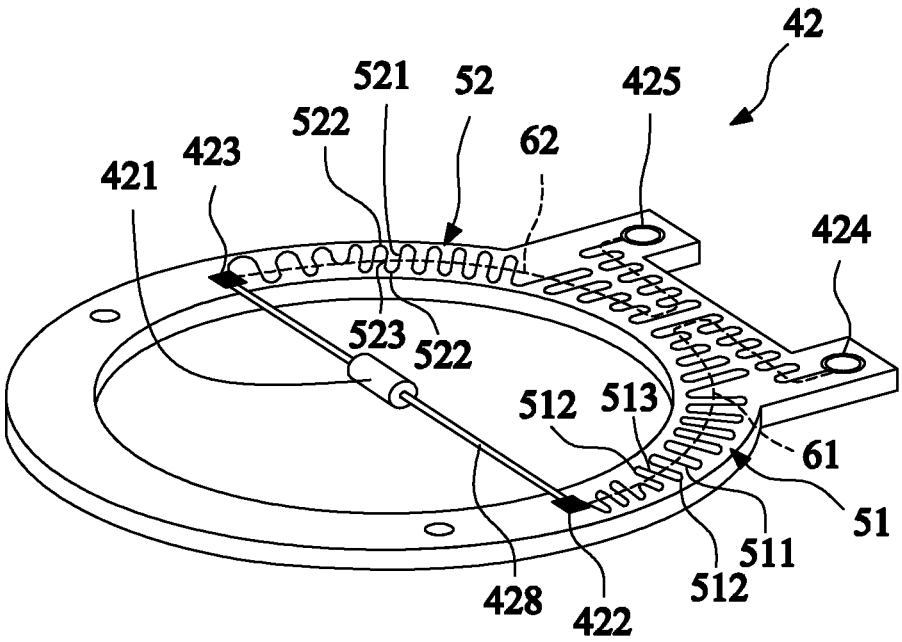
FIG. 3 is a perspective view of a circuit board in accordance with some embodiments.

FIG. 1 is a perspective view of a fan in accordance with some embodiments. FIG. 2 is an exploded perspective view of a fan in accordance with some embodiments. FIG. 3 is a perspective view of a circuit board in accordance with some embodiments. Referring to FIG. 1, FIG. 2 and FIG. 3, in an embodiment, the fan 10 having temperature detecting element includes a stator 20, an impeller 30, and a fan frame 40 having temperature detecting element. The stator 20 is used to drive the impeller 30 to rotate. The impeller 30 includes a plurality of blades 31. The fan frame 40 includes a body 41 and a circuit board 42. The body 41 is used for accommodating the stator 20 and the impeller 30. The body 41 includes a first body 411 and a second body 412. The first body 411 and the second body 412 are used to combine to cover the stator 20 and the impeller 30. The body 41 includes an inlet 413 disposed on a top surface of the first body 411.

The circuit board 42 is installed around the inlet 413 of the body 41. The circuit board 42 includes a temperature detecting element 421, a first contact end 422, a second contact end 423, a first external contact terminal 424, a second external contact terminal 425, a first wire 51 and a second wire 52. In an embodiment, the circuit board 42 can be a FR1 or FR4 substrate, preferably, the circuit board 42 is a FR1 substrate. The temperature detecting element 421 can be a DIP (Dual In-line Package) type temperature detecting element. The first body 411 includes two positioning pillars 414, 415. The circuit board 42 includes two positioning holes 426, 427. The place of the two positioning holes 426, 427 are corresponding to that of the two positioning pillars 414, 415 so that the two positioning holes 426, 427 are installed around the two positioning pillars 414, 415 to position the circuit board 42 on the first body 411. The circuit board 42 is formed as a circular ring shape.

The first contact end 422 and the second contact end 423 are connected to the temperature detecting element 421. The temperature detecting element 421 traverses the inlet 413, and is used for detecting the ambient temperature of the inlet 413. Then, the detected temperature signal is transmitted to a control system (not shown in the drawings) via the first external contact terminal 424 and the second external contact terminal 425. Further, the pins 428 of the temperature detecting element 421 can be covered by an isolation sleeve or a protection sleeve to avoid corrosion due to exposing in the air. Therefore, the lifetime of the temperature detecting element 421 can be extended.

The first wire 51 electrically connects the first contact end 422 and the first external contact terminal 424. The second wire 52 electrically connects the second contact end 423 and the second external contact terminal 425. The first wire 51 and the second wire 52 are mounted on the circuit board 42 in a layout arrangement. Preferably, the first wire 51 and the second wire 52 can be copper foils. At least one of the first wire 51 and the second wire 52 includes a plurality of bending sections. In an embodiment, both the first wire 51 and the second wire 52 include a plurality of bending sections. The first wire 51 includes a plurality of first bending sections 511, and the second wire 52 includes a plurality of second bending sections 521.

In an embodiment, the first bending section 511 includes at least one first curved segment 512, and the second bending section 521 includes at least one second curved segment 522. The first curved segment 512 and the second curved segment 522 are substantially formed as a semicircular shape. The first bending section 511 further includes at least one first straight line 513 for connecting two first curved segments 512. The second bending section 521 further includes at least one second straight line 523 for connecting two second curved segments 522.

A first path 61 (shown in a dashed line) is defined between the first contact end 422 and the first external contact terminal 424, and a second path 62 (shown in a dashed line) is defined between the second contact end 423 and the second external contact terminal 425. The first wire 51 is disposed on the first path 61, and the second wire 52 is disposed on the second path 62. Preferably, a length of the first wire 51 is larger than twice length of the first path 61, and a length of the second wire 52 is larger than twice length of the second path 62.

In an embodiment, the first bending sections 511 are substantially vertical to the first path 61, and the second bending sections 521 are substantially vertical to the second path 62. Preferably, the first wire 51 includes at least ten first bending sections 511, and the second wire 52 includes at least ten second bending sections 521.

Figure 4:
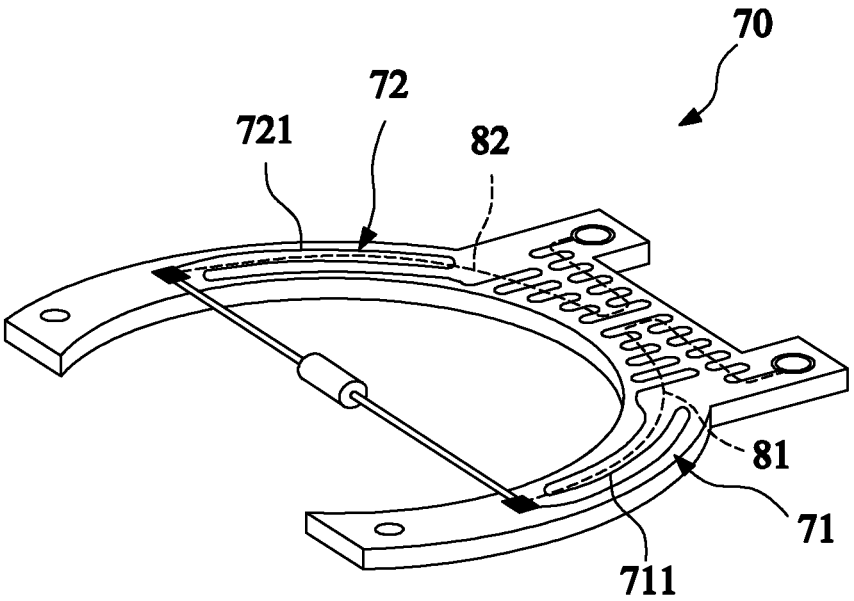
FIG. 4 is another perspective view of a circuit board in accordance with some embodiments.

FIG. 4 is another perspective view of a circuit board in accordance with some embodiments. In an embodiment, the first wire 71 of the circuit board 70 includes a plurality of first bending sections 711, and the second wire 72 includes a plurality of second bending sections 721. Part of the first bending sections 711 are substantially parallel to the first path 81, and part of the first bending sections 711 are substantially vertical to the first path 81. Part of the second bending sections 721 are substantially parallel to the second path 82, and part of the second bending sections 721 are substantially vertical to the second path 82. The circuit board 70 is formed as a semicircular ring shape.

By utilizing the first bending sections of the first wire and the second bending sections of the second wire, the length of the first wire and the second wire can be increased. Therefore, the influence in the temperature detecting element caused by the circuit board can be lowered and the error of the detecting temperature can be decreased.

Figure 5:
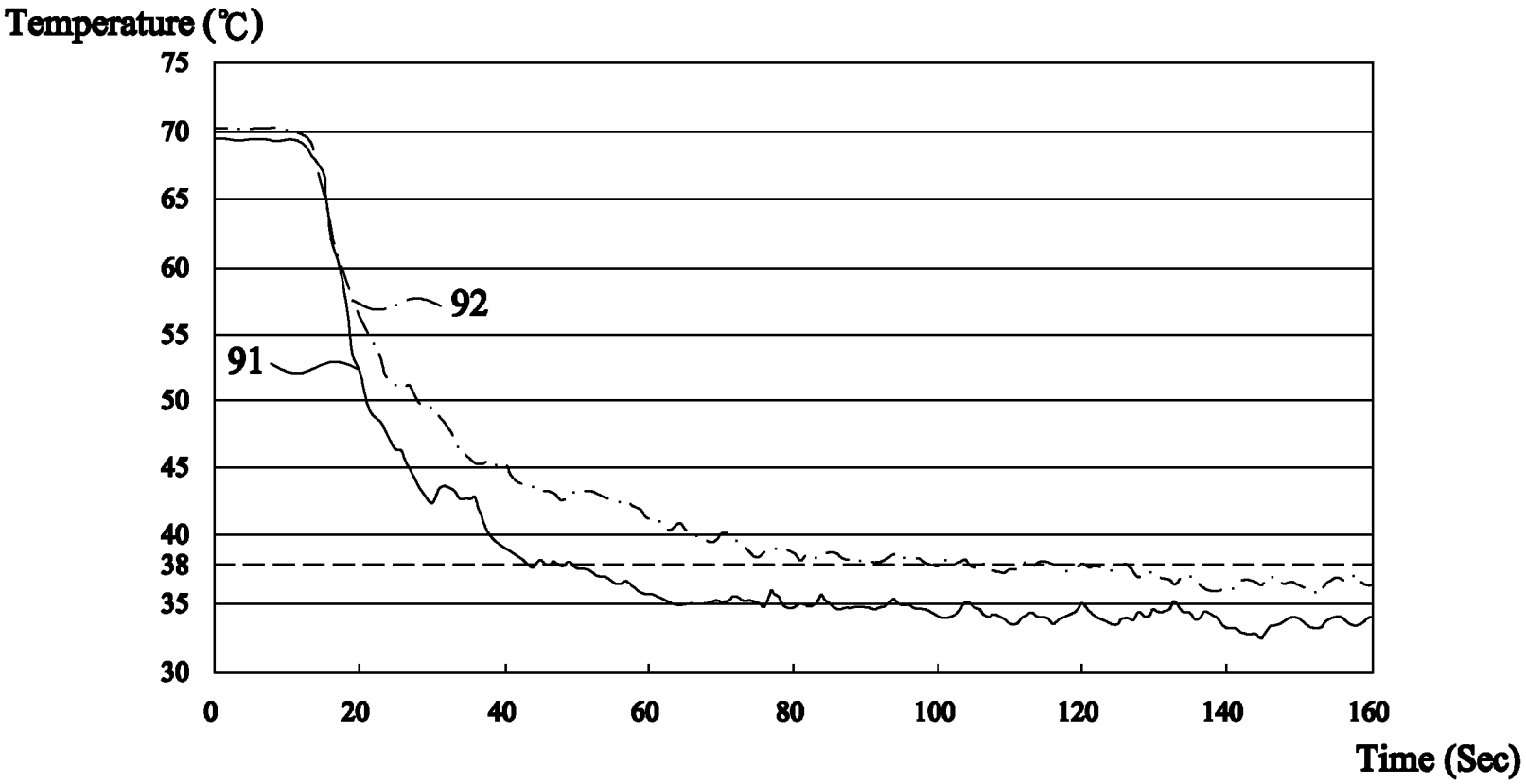
FIG. 5 shows curves of the detecting temperature for the disclosed fan and the conventional fan.

FIG. 5 shows curves of the detecting temperature for the disclosed fan and the conventional fan. In an experience, the disclosed fan and the conventional fan are disposed under high temperature 70° C. for two hours, then are disposed under room temperature 25° C. to observe the change of the detecting temperature of the temperature detecting element. The objective value for decreasing temperature is predetermined to be 38° C. The detecting temperature curve 91 of the disclosed fan and the detecting temperature curve 92 of the conventional fan are shown in FIG. 5. For the disclosed fan, the time from 70° C. to the objective value 38° C. is 43 seconds. For the conventional fan, the time from 70° C. to the objective value 38° C. is 98 seconds. Apparently, by utilizing the first bending sections of the first wire and the second bending sections of the second wire, the length of the first wire and the second wire can be increased. Therefore, the influence in the temperature detecting element caused by the circuit board can be lowered and the error of the detecting temperature can be decreased.

While the embodiment of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and all modifications that maintain the spirit and scope of the present invention are within the scope as defined in the appended claims.

What is claimed is:

1. A fan frame having temperature detecting element, comprising:

a body for accommodating an impeller, the body comprising an inlet; and a circuit board installed around the inlet of the body, the circuit board comprising a temperature detecting element, a first contact end, a second contact end, a first external contact terminal, a second external contact terminal, a first wire and a second wire, wherein the first contact end and the second contact end are connected to the temperature detecting element, the temperature detecting element traverses the inlet, the first wire electrically connects the first contact end and the first external contact terminal, the second wire electrically connects the second contact end and the second external contact terminal, at least one of the first wire and the second wire comprises a plurality of bending sections;

wherein the first wire comprises a plurality of first bending sections, and the second wire comprises a plurality of second bending sections;

wherein a first path is defined between the first contact end and the first external contact terminal, a second path is defined between the second contact end and the second external contact terminal, the first wire is disposed on the first path, the second wire is disposed on the second path, a length of the first wire is larger than twice length of the first path, a length of the second wire is larger than twice length of the second path.

2. The fan frame according to claim 1, wherein the first bending section comprises at least one first curved segment, and the second bending section comprises at least one second curved segment.

3. The fan frame according to claim 2, wherein the first bending section further comprises at least one first straight line for connecting two first curved segments, and the second bending section further comprises at least one second straight line for connecting two second curved segments.

4. The fan frame according to claim 1, wherein the first bending sections are substantially vertical to the first path, and the second bending sections are substantially vertical to the second path.

5. The fan frame according to claim 1, wherein part of the first bending sections are substantially parallel to the first path, and part of the second bending sections are substantially parallel to the second path.

6. The fan frame according to claim 1, wherein the first wire comprises at least ten first bending sections, and the second wire comprises at least ten second bending sections.

7. The fan frame according to claim 1, wherein the circuit board is a FR1 substrate.

8. A fan having temperature detecting element, comprising:

a stator;

an impeller;

a fan frame having temperature detecting element, comprising:

a body for accommodating the impeller and the stator, the body comprising an inlet; and a circuit board installed around the inlet of the body, the circuit board comprising a temperature detecting element, a first contact end, a second contact end, a first external contact terminal, a second external contact terminal, a first wire and a second wire, wherein the first contact end and the second contact end are connected to the temperature detecting element, the temperature detecting element traverses the inlet, the first wire electrically connects the first contact end and the first external contact terminal, the second wire electrically connects the second contact end and the second external contact terminal, at least one of the first wire and the second wire comprises a plurality of bending sections;

wherein the first wire comprises a plurality of first bending sections, and the second wire comprises a plurality of second bending sections;

wherein a first path is defined between the first contact end and the first external contact terminal, a second path is defined between the second contact end and the second external contact terminal, the first wire is disposed on the first path, the second wire is disposed on the second path, a length of the first wire is larger than twice length of the first path, a length of the second wire is larger than twice length of the second path.

9. The fan according to claim 8, wherein the first bending section comprises at least one first curved segment, and the second bending section comprises at least one second curved segment.

10. The fan according to claim 9, wherein the first bending section further comprises at least one first straight line for connecting two first curved segments, and the second bending section further comprises at least one second straight line for connecting two second curved segments.

11. The fan according to claim 8, wherein the first bending sections are substantially vertical to the first path, and the second bending sections are substantially vertical to the second path.

12. The fan according to claim 8, wherein part of the first bending sections are substantially parallel to the first path, and part of the second bending sections are substantially parallel to the second path.

13. The fan according to claim 8, wherein the first wire comprises at least ten first bending sections, and the second wire comprises at least ten second bending sections.

14. The fan according to claim 8, wherein the circuit board is a FR1 substrate.

15. A fan frame having temperature detecting element, comprising:

a body for accommodating an impeller, the body comprising an inlet; and a circuit board installed around the inlet of the body, the circuit board comprising a temperature detecting element, a first contact end, a second contact end, a first external contact terminal, a second external contact terminal, a first wire and a second wire, wherein the first contact end and the second contact end are connected to the temperature detecting element, the temperature detecting element traverses the inlet, the first wire electrically connects the first contact end and the first external contact terminal, the second wire electrically connects the second contact end and the second external contact terminal, at least one of the first wire and the second wire comprises a plurality of bending sections;

wherein the first wire comprises a plurality of first bending sections, and the second wire comprises a plurality of second bending sections;

wherein the first wire comprises at least ten first bending sections, and the second wire comprises at least ten second bending sections.

16. A fan having temperature detecting element, comprising:

a stator;

an impeller;

a fan frame having temperature detecting element, comprising:

a body for accommodating the impeller and the stator, the body comprising an inlet; and a circuit board installed around the inlet of the body, the circuit board comprising a temperature detecting element, a first contact end, a second contact end, a first external contact terminal, a second external contact terminal, a first wire and a second wire, wherein the first contact end and the second contact end are connected to the temperature detecting element, the temperature detecting element traverses the inlet, the first wire electrically connects the first contact end and the first external contact terminal, the second wire electrically connects the second contact end and the second external contact terminal, at least one of the first wire and the second wire comprises a plurality of bending sections;

wherein the first wire comprises a plurality of first bending sections, and the second wire comprises a plurality of second bending sections;

wherein the first wire comprises at least ten first bending sections, and the second wire comprises at least ten second bending sections.

* * * * *